US006443455B1

(12) United States Patent
Webb

(10) Patent No.: US 6,443,455 B1
(45) Date of Patent: Sep. 3, 2002

(54) METHOD AND APPARATUS FOR PLAYING A TWO-HAND POKER GAME

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

(21) Appl. No.: 09/538,486

(22) Filed: Mar. 30, 2000

Related U.S. Application Data

(60) Provisional application No. 60/127,300, filed on Mar. 30, 1999.

(51) Int. Cl.[7] ..... A63F 3/08
(52) U.S. Cl. ..... 273/274; 273/292; 463/13
(58) Field of Search ..... 273/274, 236, 273/292; 463/13

(56) References Cited

U.S. PATENT DOCUMENTS 4,659,087 A * 4/1987 Shen et al.
5,294,128 A * 3/1994 Marquez
5,584,486 A * 12/1996 Franklin
5,863,041 A * 1/1999 Boylan
6,007,424 A * 12/1999 Evers et al.

* cited by examiner

*Primary Examiner*—Benjamin H. Layno
*Assistant Examiner*—Vishu K Mendiratta
(74) *Attorney, Agent, or Firm*—Nixon & Vanderhye P.C.

(57) ABSTRACT

A two-hand poker game is played using one or more decks of playing cards. To play the game, each player must place a double-hand wager and may place an optional bonus wager. Six cards are dealt to each player and the dealer, and each player and the dealer forms a high three-card hand and a low three-card hand. The double-hand wager is resolved according to game rules based on a comparison of the player high and low three-card hands and the dealer high and low three-card hands, respectively. The optional bonus wager, if received from the player, is resolved according to respective hand ranks of the player high and low three-card hands. Resolution of the double bonus wager is thus determined regardless of the result against the dealer with respect to the double-hand wager. In one operating mode, in order to increase the house advantage, a Joker is incorporated into the deck of cards, which Joker may be used differently by the players and the dealer. In an alternative operating mode, at least one of the dealer hands may be qualified such that for example when the dealer low hand is below a certain rank, the low hand is regarded as a tie, and the game outcome is determined by the high hands only.

20 Claims, 2 Drawing Sheets

METHOD AND APPARATUS FOR PLAYING A TWO-HAND POKER GAME

This application claims the benefit of provisional application Ser. No. 60/127,300 filed Mar. 30, 1999.

BACKGROUND OF THE INVENTION

The present invention relates to a casino poker game and, more particularly, to a casino poker game incorporating a two-hand result against a dealer as well as a proposition wager that is based on respective hand ranks of the player hands.

Pai Gow Poker is normally played in a casino or card club environment. The game was originally based on Chinese Dominoes or Pai Gow, and the card version may be known by other names such as Asian Poker and Double Hand as in this text. The deck is a regular 52-card deck with a Joker added comprising a total 53-card deck. The game may be played by up to six players and one bank with the dealer commonly being the banker in a casino but a player commonly being the banker in a card club. The text assumes dealer as banker for simplicity.

Although Double Hand is growing significantly, the game has certain rituals and practices that tend to slow the game pace and is limited to six players only as each player and dealer receive seven cards. Also, the use of commission on winnings to generate a house advantage is detrimental to a fast dealing pace.

A bet is made before cards are dealt. Each player is dealt seven cards and forms a five-card high hand and a two-card low hand. The five-card hand is based on normal poker rankings, and the two-card hand is based on pairs and high cards. The two-card hand must not be higher than the five-card hand. Each player hand is compared to the corresponding dealer hands. To win the bet, both hands must win, and to lose the bet, both hands must lose. If one hand wins and one loses, it is a tie, known as push.

The house advantage is generated by two means. Firstly, a commission as a percentage of winnings is paid on all winning hands, usually 5%. Secondly, the house wins all copy hands, that is, where either the high or low hand is tied. Thus, the player with a copy and a loss loses, whilst the player with a copy and a win pushes.

A dealer having to determine and deduct 5% of bets is time consuming. Double Hand would play faster if the commission aspect could be removed. Also, dealers normally deal the maximum number of seven-card hands regardless of the number of players and distribute cards by random selection of a first player by using dice or an illuminated display from 1 to 6 set into the table. If Double Hand could be dealt to seven players, rather than six, as with most other casino card games, table utilization could be improved.

SUMMARY OF THE INVENTION

The game according to the invention, so-called 3×3 Double Hand, is played on a Blackjack or Poker shaped table with a dealer and a regular deck of 52 cards or with 53 cards if using the Joker version. Prior to receiving a hand, each player places a wager to participate in the basic double hand game and an optional double bonus wager if choosing to do so.

The dealer deals to each player and self in rotation, one card at a time, giving each player and self a total of six cards. Each player forms a high three-card poker hand and a low three-card poker hand. After each player has set their hands (i.e., set a high hand and a low hand), the dealer hands are exposed and are compared under the double hand rules, wherein a player wins if, for example, both high and low win, loses if both high and low lose, and pushes if winning either high or low and losing the other hand. The dealer preferably wins copy hands, so player win and copy is a push, and player lose and copy, or player copy and copy are both player losses.

The double bonus wager is paid regardless of the result against the dealer and according to the game payoffs. For example, if both high and low are a Pair or better, then a double pair payoff is paid. If both high and low are a Flush or better, then a double flush payoff is paid. This methodology is extended to double ranks of Straight, Three of a Kind, and Straight Flush.

In accordance with an exemplary embodiment of the present invention, a method of playing a two-hand poker game using one or more decks of playing cards includes the steps of receiving a double-hand wager and an optional bonus wager from a player, and dealing six cards to the player and six cards to a dealer. Player and dealer each form a high three-card hand and a low three-card hand. The double-hand wagers are resolved according to game rules based on a comparison of the player high and low three-card hands and the dealer high and low three-card hands, respectively. The optional bonus wager, if received from the player, is resolved according to respective hand ranks of the player high and low three-card hands.

The step of resolving the double-hand wagers may be practiced by (i) paying wagers when the player high three-card hand and the player low three-card hand beat the dealer high three-card hand and the dealer low three-card hand, respectively, (ii) pushing wagers when one of the player high and low three-card hands beats the respective dealer high and low three-card hand and the other of the player high and low three-card hands loses to the respective other dealer high and low three-card hand, and (iii) taking wagers when the player high three-card hand and the player low three-card hand lose to the dealer high three-card hand and the dealer low three-card hand, respectively.

In this context, step (ii) may be practiced by pushing wagers when one of the player high and low three-card hands beats the respective dealer high and low three-card hand and the other of the player high and low three-card hands ties the respective other dealer high and low three-card hand. Step (iii) may be practiced by taking wagers when one of the player high and low three-card hands loses to the respective dealer high and low three-card hand and the other of the player high and low three-card hands ties the respective other dealer high and low three-card hand or when the player high three-card hand and the player low three-card hand tie the dealer high three-card hand and the dealer low three-card hand, respectively.

The optional bonus wager is preferably resolved by paying wagers when each of the player high and low three-card hands exceeds a predetermined hand rank. Increasing payouts may be paid for increasing hand ranks, wherein possible hand ranks include, in descending order:

Straight Flush—Three Cards Suited in Sequence,

Three of a Kind—Three Cards of a Same Rank,

Straight—Three Cards in Sequence,

Flush—Three Cards Suited,

Pair—Two Cards of a Same Rank, and

High Card—None of the Above.

The predetermined hand rank for the optional bonus wager is preferably a pair, such that the bonus wager is paid when each of the player high and low three-card hands exceeds at least a pair.

The method may further include qualifying the dealer low three-card hand, wherein an unqualified dealer low hand is declared as a tie, and the double-hand wager is resolved according to a comparison of the player high three-card hand and the dealer high three-card hand. In one operating mode, the one or more decks of playing cards contain at least one Joker, which is considered as a wild card. The player and dealer may use the at least one Joker, but with the usage extent limited and different for the player and the dealer.

The resolution of the double-hand wagers is determined by comparing hand ranks of the player high and low three-card hands and the dealer high and low three-card hands, respectively. Possible ranks correspond to those noted above.

In accordance with another aspect of the invention, a casino card game includes at least one deck of playing cards, and a game table. The game table is provided with a first betting area for receiving a double-hand wager, a second betting area for receiving an optional bonus wager, and a player card area and a dealer card area each for receiving six cards dealt by a dealer to the player. The player card area and the dealer card area each contain a high hand area and a low hand area for receiving player and dealer high three-card hands and low three-card hands, respectively. The double-hand wager is resolved according to game rules based on a comparison of the player high and low three-card hands and the dealer high and low three-card hands, respectively. The optional bonus wager, if received from the player, is resolved according to respective hand ranks of the player high and low three-card hands.

In accordance with yet another aspect of the present invention, a method of playing a two-hand poker game using one or more decks of playing cards includes the steps of receiving a double-hand wager and an optional bonus wager from the player, and dealing a plurality of cards to the player and the corresponding plurality of cards to a dealer. The player and dealer each form a high hand including some of the plurality of cards and a low hand including others of the plurality of cards. The double-hand wager is resolved according to game rules, and the optional bonus wager, if received from the player, is resolved according to respective hand ranks of the player high and low hands, regardless of the resolution of the double-hand wager.

In accordance with still another aspect of the present invention, there is provided a computer program to carry out the method according to the present invention of playing a two-hand poker game using one or more decks of playing cards. The computer includes a processor, an input communicating with the processor, and a display, wherein the processor enables the steps of the described method.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

Figure 1:
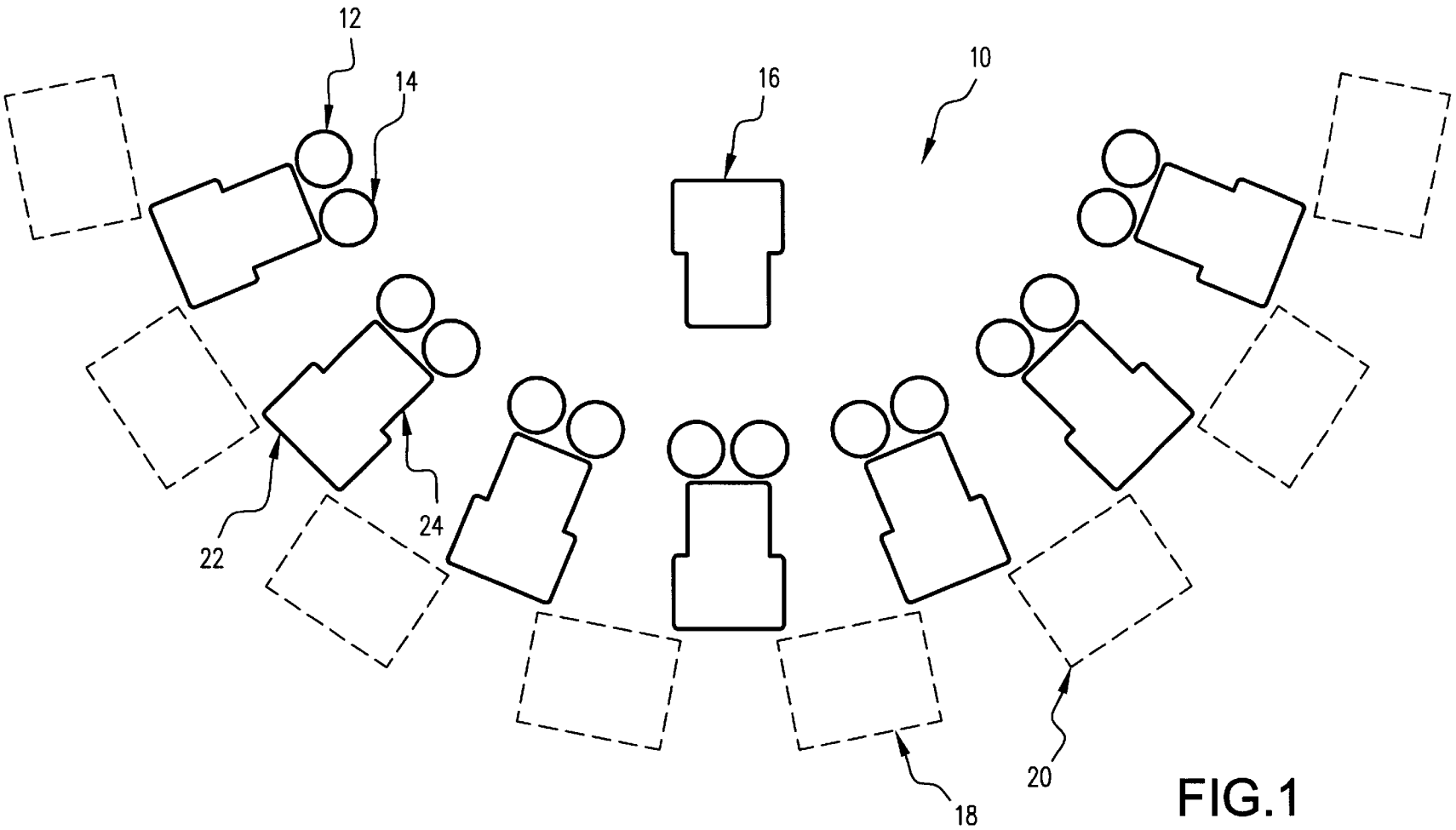
FIG. 1 is a plan view of the table layout according to the present invention.

FIG. 1 shows a playing surface or table layout 10 that is suitable for the game according to the present invention. The layout 10 includes a primary betting area 12 for each of a plurality of players, for example, seven players, and a secondary betting area 14, which corresponds with each primary betting area 12. The layout also includes a dealer area 16 as well as payoff scales 18 and game rules 20. Each player area includes a high hand area 22 and a low hand area 24.

In order to play the game, the player must make a double-hand wager at the primary betting area 12 to participate in the basic game. The one or more players may also elect to place an additional double bonus wager at the secondary betting area 14. The amount of the double bonus wager at area 14 may be limited to a predetermined factor of the double-hand wager at area 12. In a preferred operating mode, the wagers must be equal. Of course, many alternative relationships between the wagers may be contemplated.

Once wagers are placed, a dealer deals to each player and self in rotation a total of six cards each. Each player determines the best way to make a high hand and a low hand as dictated by the game rules at area 20, wherein each player places the high hand in area 22 and the low hand in area 24. The dealer uses the same process, making a high hand and a low hand within the dealer area 16. Each player result is then settled in rotation including the double-hand wager at area 12 and, if played, the double bonus wager at area 14.

The double-hand wager at area 12 is a wager that the hand ranks of the player high hand and low hand, respectively, will exceed the hand ranks of the corresponding dealer high hand and low hand. Resolving the double-hand wager according to the rules of the game is thus accomplished by comparing the player high and low three-card hands and the dealer high and low three-card hands, respectively. Possible hand ranks for each three-card hand include, in order from highest rank to lowest rank:

| | |
|---|---|
| Straight Flush | Three Cards Suited in Sequence (Includes Royal Flush) |
| Three of a Kind | Three Cards of a Same Rank |
| Straight | Three Cards in Sequence |
| Flush | Three Cards Suited |
| Pair | Two Cards of a Same Rank |
| High Card | None of the Above |

If both of the player high hand and low hand hand ranks exceed the corresponding hand ranks of the dealer hands, the player wins, and the double-hand wager is preferably paid 1 to 1. On the other hand, if both hands lose, the player loses the double-hand wager, and the wager is taken. The double-hand wager is pushed if either the high hand or low hand wins but the other hand loses. With respect to copy hands, i.e., hands of the same rank, in a preferred operating mode, the dealer wins copy hands. Thus, with respect to the two player and dealer hands, player win and copy results in a pushed wager, and player lose and copy or player copy and copy are both player losses, and the double-hand wager is taken.

The copy hand preference retains a house advantage, which advantage, however, may or may not be sufficient to make the game operationally viable and desirable to casino operators. Using the high and low three-card hands, the incidence of copy hands is decreased in the low hand but increased in the high hand with an overall decreased frequency as compared to conventional Double Hand. As a consequence, using a 5% commission also may not be sufficient. In order to create further house advantage, in a one operating mode, the deck incorporates one or more Jokers, and in one example, a player may only use the Joker in a Straight, Flush or Straight Flush, whereas the dealer may use the Joker as noted and also as an Ace. In another example, the player may only use the Joker in a high hand, whereas the dealer may use the Joker in either the high hand or low hand. Certainly, there are alternative permutations of this version using a Joker, and the invention is not meant to be limited to any one particular version.

In an another operating mode to still further add to the house advantage, when the dealer low hand is below a certain rank, such as Queen high or better, then the dealer low hand is regarded as a tie, and the game outcome is determined by the high hand only. Varying the qualification creates different house advantages. In conjunction with this operating mode incorporating an appropriate qualification, the dealer or player could win high or low copy or any copy.

The double bonus wager, if received from the player, is resolved according to respective hand ranks of the player high and low three-card hands. Thus, the double bonus wager is resolved regardless of the result against the dealer and according to the game payoffs. For example, if both the player high and low hands are a pair or better, then a double pair payoff is paid. If both the player high and low hands are a flush or better, then a double flush payoff is paid. This methodology is extended to double ranks of Straight, Three of a Kind, and Straight Flush. Preferably, the payout for the double bonus wager increases with increasing hand ranks.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the preferred embodiments. Control logic can be loaded into the memory of a computer and executed by a central processing unit (CPU) to perform the operations described herein.

Figure 2:
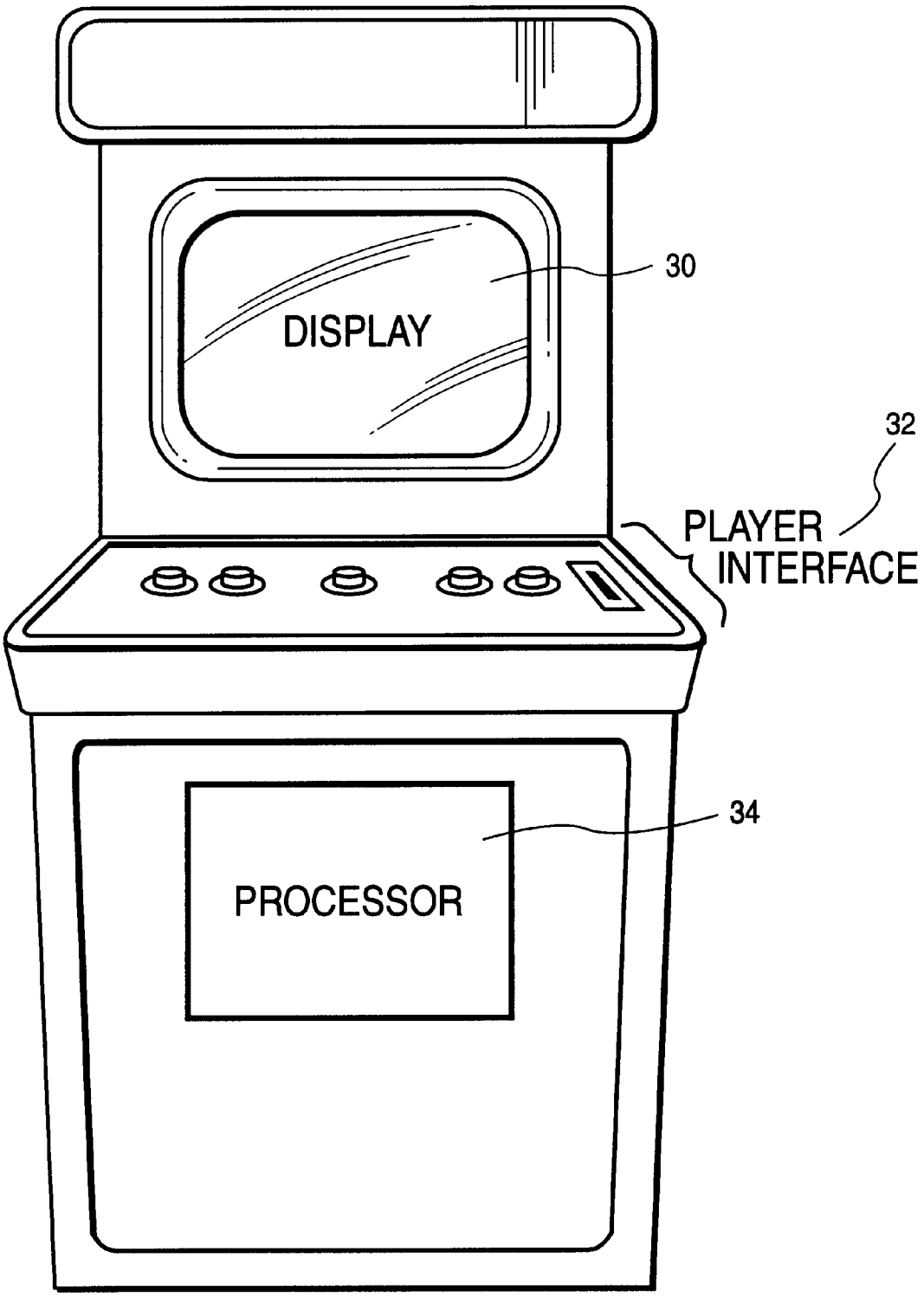
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34 for effecting game play and including structure for receiving wagers, dealing cards and resolving wagers according to the game rules. That is, a processing circuit 34 is programmed to effect game play according to the rules of the game and resolves double-hand wagers based on a comparison of respective player and dealer high and low hands and resolves bonus wagers based on the hand ranks of the player high and low hands.

With the method and apparatus according to the invention, conventional two-hand multi-card poker games have been improved. In particular, since only six cards are dealt to each player and dealer, seven players can be accommodated rather than six. Moreover, each player has the option to benefit from an extra side wager, the double bonus wager, which is unrelated to the double-hand wager against the dealer. Still further, the players enjoy a perception of being able to form better hands, as three-card pat hands are more frequent than five-card pat hands. Game pace is improved without a requirement for small change to charge commission on winning bets. It is also easier for novice players to set the hands correctly as there is less potential for situations where the correct manner of setting the high and low hands is unclear.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a two-hand poker game using one or more decks of playing cards, the method comprising:

(a) receiving a double-hand wager and an optional bonus wager from a player;

(b) dealing six cards to the player and six cards to a dealer;

(c) the player and dealer each forming a high three-card hand and a low three-card hand;

(d) resolving the double-hand wager according to game rules based on a comparison of the player high and low three-card hands and the dealer high and low three-card hands, respectively; and (e) resolving the optional bonus wager, if received from the player, according to respective hand ranks of the player high and low three-card hands.

2. A method according to claim 1, wherein step (d) is practiced by (d1) paying wagers when the player high three-card hand and the player low three-card hand beat the dealer high three-card hand and the dealer low three-card hand, respectively, (d2) pushing wagers when one of the player high and low three-card hands beats the respective dealer high and low three-card hand and the other of the player high and low three-card hands loses to the respective other dealer high and low three-card hand, and (d3) taking wagers when the player high three-card hand and the player low three-card hand lose to the dealer high three-card hand and the dealer low three-card hand, respectively.

3. A method according to claim 2, wherein step (d2) is practiced by pushing wagers when one of the player high and low three-card hands beats the respective dealer high and low three-card hand and the other of the player high and low three-card hands ties the respective other dealer high and low three-card hand, and wherein step (d3) is practiced by taking wagers when one of the player high and low three-card hands loses to the respective dealer high and low three-card hand and the other of the player high and low three-card hands ties the respective other dealer high and low three-card hand or when the player high three-card hand and the player low three-card hand tie the dealer high three-card hand and the dealer low three-card hand, respectively.

4. A method according to claim 1, wherein step (e) is practiced by paying wagers when each of the player high and low three-card hands exceeds a predetermined hand rank.

5. A method according to claim 4, wherein step (e) is practiced by paying increasing payouts for increasing hand ranks, and wherein possible hand ranks include, in descending order:

straight flush—three cards suited in sequence, three of a kind—three cards of a same rank, straight—three cards in sequence, flush—three cards suited, pair—two cards of a same rank, and high card—none of the above.

6. A method according to claim 5, wherein the predetermined hand rank is pair, such that step (e) is practiced by paying wagers when each of the player high and low three-card hands exceeds a pair.

7. A method according to claim 1, further comprising qualifying the dealer low three-card hand, wherein step (d) is practiced by declaring an unqualified dealer low three-card hand as a tie, and resolving the double-hand wager according to a comparison of the player high three-card hand and the dealer high three-card hand.

8. A method according to claim 1, wherein the one or more decks of playing cards contain at least one joker, and wherein steps (d) and (e) are practiced by considering the at least one joker as a wild card.

9. A method according to claim 8, wherein the player and the dealer may use the at least one joker, and wherein the usage extent of the at least one joker is limited and different for the player and the dealer, respectively.

10. A method according to claim 1, wherein step (d) is practiced by comparing hand ranks of the player high and low three-card hands and the dealer high and low three-card hands, respectively, and wherein possible hand ranks include, in descending order:

straight flush—three cards suited in sequence, three of a kind—three cards of a same rank, straight—three cards in sequence, flush—three cards suited, pair—two cards of a same rank, and high card—none of the above.

11. A casino card game, comprising:

at least one deck of playing cards; and a game table, the game table including:

a first betting area for receiving a double-hand wager, a second betting area for receiving an optional bonus wager, and a player card area and a dealer card area each for receiving six cards dealt by a dealer to a player, the player card area and the dealer card area each containing a high hand area and a low hand area for receiving player and dealer high three-card hands and low three-card hands, respectively, wherein the double-hand wager is resolved according to game rules based on a comparison of the player high and low three-card hands and the dealer high and low three-card hands, respectively, and wherein the optional bonus wager, if received from the player, is resolved according to respective hand ranks of the player high and low three-card hands.

12. A casino card game according to claim 11, wherein the at least one deck of cards comprises at least one joker that is used as a wild card.

13. A casino card game according to claim 12, wherein the player and the dealer may use the at least one joker, and wherein the usage extent of the at least one joker is limited and different for the player and the dealer, respectively.

14. A computer programmed to carry out a method of playing a two-hand poker game using one or more decks of playing cards, the computer including a processor, an input communicating with the processor, and a display, the processor enabling the steps of:

(a) receiving a double-hand wager and an optional bonus wager from a player;

(b) dealing six cards to the player and six cards to a dealer;

(c) the player and dealer each forming a high three-card hand and a low three-card hand;

(d) resolving the double-hand wager according to game rules based on a comparison of the player high and low three-card hands and the dealer high and low three-card hands, respectively; and (e) resolving the optional bonus wager, if received from the player, according to respective hand ranks of the player high and low three-card hands.

15. A computer according to claim 14, wherein step (d) is practiced by (d1) paying wagers when the player high three-card hand and the player low three-card hand beat the dealer high three-card hand and the dealer low three-card hand, respectively, (d2) pushing wagers when one of the player high and low three-card hands beats the respective dealer high and low three-card hand and the other of the player high and low three-card hands loses to the respective other dealer high and low three-card hand, and (d3) taking wagers when the player high three-card hand and the player low three-card hand lose to the dealer high three-card hand and the dealer low three-card hand, respectively.

16. A computer according to claim 14, wherein step (e) is practiced by paying wagers when each of the player high and low three-card hands exceeds a predetermined hand rank.

17. A computer according to claim 14, further comprising qualifying the dealer low three-card hand, wherein step (d) is practiced by declaring an unqualified dealer low three-card hand as a tie, and resolving the double-hand wager according a comparison of the player high three-card hand and the dealer high three-card hand.

18. A computer according to claim 14, wherein the one or more decks of playing cards contain at least one joker, and wherein steps (d) and (e) are practiced by considering the at least one joker as a wild card.

19. A computer according to claim 14, wherein step (d) is practiced by comparing hand ranks of the player high and low three-card hands and the dealer high and low three-card hands, respectively, and wherein possible hand ranks include, in descending order:

straight flush—three cards suited in sequence, three of a kind—three cards of a same rank, straight—three cards in sequence, flush—three cards suited, pair—two cards of a same rank, and high card—none of the above.

20. An apparatus for playing a two-hand poker game using one or more decks of playing cards, the apparatus comprising:

means for receiving a double-hand wager and an optional bonus wager from a player;

means for dealing six cards to the player and six cards to a dealer;

means for the player and dealer each forming a high three-card hand and a low three-card hand;

means for resolving the double-hand wager according to game rules based on a comparison of the player high and low three-card hands and the dealer high and low three-card hands, respectively; and means for resolving the optional bonus wager, if received from the player, according to respective hand ranks of the player high and low three-card hands.

* * * * *